United States Patent [19]

Knoll

[11] 4,158,156

[45] Jun. 12, 1979

[54] ELECTRON BALLAST APPARATUS FOR GASEOUS DISCHARGE LAMPS

[75] Inventor: William C. Knoll, Turbotville, Pa.

[73] Assignee: GTE Sylvania Incorporated, Stamford, Conn.

[21] Appl. No.: 873,401

[22] Filed: Jan. 30, 1978

[51] Int. Cl.[2] ..... H05B 41/16; H05B 41/24

[52] U.S. Cl. ..... 315/278; 315/185 R; 315/187; 315/209 R; 315/DIG. 5; 336/172; 336/212

[58] Field of Search ..... 315/278, 185, 189, 192, 315/209, DIG. 5; 336/212, 172, 173

[56] References Cited

U.S. PATENT DOCUMENTS

| | | | |
|---|---|---|---|
| 2,312,867 | 3/1943 | Boucher | 315/278 X |
| 2,337,992 | 12/1943 | Hall, Jr. et al. | 315/287 X |
| 2,337,993 | 12/1943 | Hall, Jr. et al. | 315/278 X |
| 3,418,527 | 12/1968 | Miller | 315/189 X |

*Primary Examiner*—Saxfield Chatmon, Jr.
*Attorney, Agent, or Firm*—Thomas H. Buffton

[57] ABSTRACT

Electronic ballast apparatus includes a transformer having an "E"-shaped core member with a primary winding wrapped on a center leg member and coupled to a potential source and first and second secondary windings each wrapped on a first and second outer leg member of the core member and coupled to gaseous discharge lamps such that flux developed in the primary winding is differentially divided between the first and second secondary windings in inverse relation to energization of the gaseous discharge lamps.

7 Claims, 4 Drawing Figures

ELECTRON BALLAST APPARATUS FOR GASEOUS DISCHARGE LAMPS

CROSS REFERENCE TO OTHER APPLICATIONS

An application entitled "High Power Conversion Circuitry" bearing U.S. Ser. No. 793,875, filed May 4, 1977 in the name of William C. Knoll is directed to electronic ballast apparatus for providing a substantially uniform DC potential for a high frequency inverter. An application entitled "Lamp Ballast Circuit" bearing U.S. Ser. No. 826,051, filed Aug. 19, 1977 in the name of William C. Knoll is directed to electronic ballast apparatus having a load feedback technique for driving a high frequency inverter. An application entitled "Lamp Ballast Circuit" bearing U.S. Ser. No. 826,541, filed Aug. 17, 1977 in the name of Charles A. Goepel is directed to electronic ballast apparatus having a transient voltage compensating circuit for "start-up" protection.

BACKGROUND OF THE INVENTION

This invention relates to electronic ballast apparatus for coupling a potential source to a load in the form of gaseous discharge lamps and more specifically to electronic ballast apparatus for coupling a high frequency inverter means to a pair of gaseous discharge lamps.

Present-day ballast apparatus commonly employs an auto-transformer for coupling a potential source to a pair of fluorescent lamps. As is well known, such apparatus is undesirably heavy and cumbersome to use with fluorescent lamp fixtures. Also, such apparatus is relatively inefficient, generates undesired heat, is undesirably wasteful of energy, and operates at a frequency (60Hz) which frequently causes undesired audio problems.

Another known form of ballast apparatus is the saturable core transformer. Therein, core saturation characteristics are utilized to limit current flow. However, saturation characteristics are most difficult to accurately control which inhibits the attainment of a desired reliability capability for such apparatus.

OBJECTS AND SUMMARY OF THE INVENTION

An object of the present invention is to provide enhanced electronic ballast apparatus. Another object of the invention is to overcome the above-mentioned difficulties of the prior art. Still another object of the invention is to provide ballast apparatus of improved reliability and control. A further object of the invention is to provide a unique transformer coupling a potential source to a lamp load. A still further object of the invention is to provide an improved process for fabricating electronic ballast apparatus.

These and other objects, advantages and capabilities are achieved in one aspect of the invention by an "E"-shaped transformer coil with a primary winding wrapped on a center leg member and first and second secondary windings wrapped on first and second outer leg members respectively. The primary winding is coupled to a potential source and the first and second secondary windings are coupled to a pair of gaseous discharge lamps.

The improved electronic ballast apparatus is fabricated by a process which includes the steps of selecting an "E"-shaped core member having a center and first and second outer leg members, wrapping a primary winding on the center leg member and coupling it to a potential source, wrapping a first secondary winding on one of the first and second outer leg members and coupling it to a gaseous discharge lamp, and wrapping a second secondary winding on the outer one of the first and second outer leg members and coupling it to a gaseous discharge lamp and to the first secondary winding.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
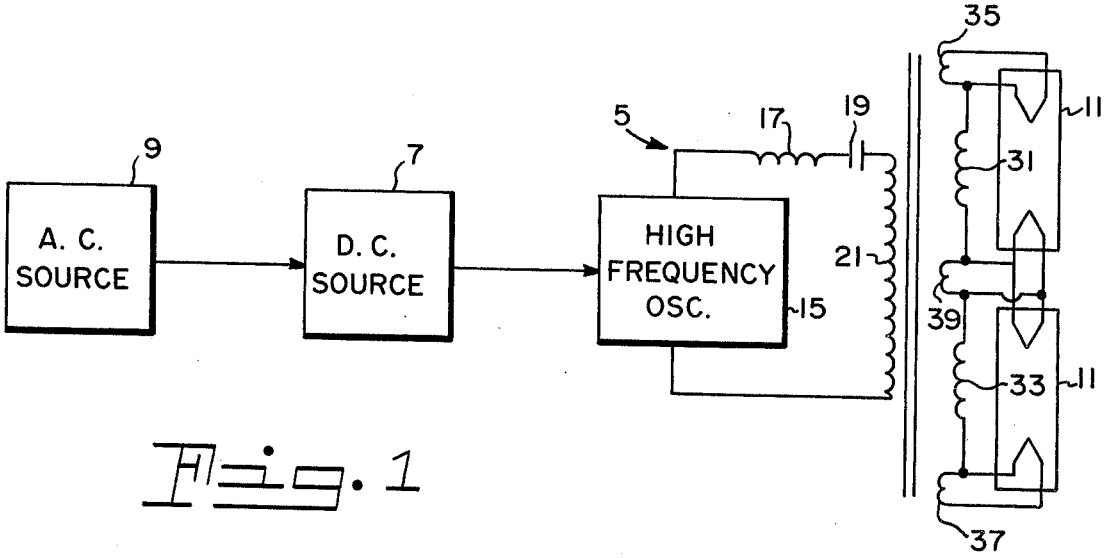
FIG. 1 is a preferred embodiment of electronic ballast apparatus for gaseous discharge devices.

Referring to the drawings, FIG. 1 illustrates a preferred form of electronic ballast apparatus. Therein, a high frequency inverter means 5 is coupled by way of a DC rectifier means 7 to an AC potential source 9. Also, the high frequency inverter means 5 is coupled to a pair of gaseous discharge lamps 11 by way of a transformer 13.

The high frequency inverter means 5 preferably includes a high frequency oscillator 15, operating at a frequency of about 20 KHz, and a capacitor 17 and inductor 19 series coupling the oscillator 15 to a primary winding 21 of the transformer 13. For a detailed description of a preferred form of high frequency inverter means 5 and DC rectifier means 7, reference is made to Applicant's co-pending application entitled "Lamp Ballast Circuit" filed Aug. 19, 1977 and bearing U.S. Ser. No. 826,051.

Figure 2:
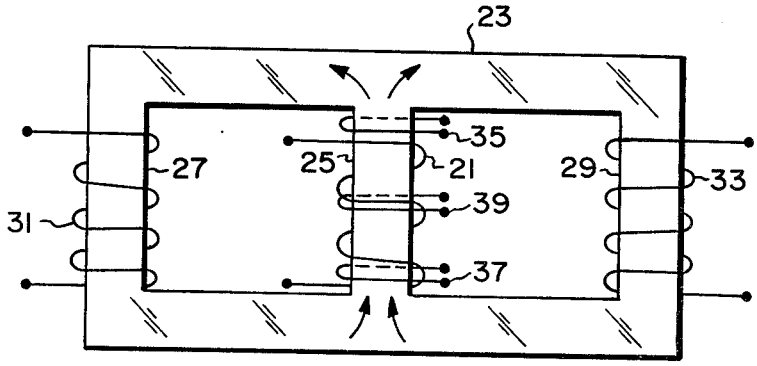
FIG. 2 is an illustration of a transformer fabricated in accordance with the apparatus of FIG. 1.

The transformer 13, diagrammatically illustrated in FIG. 2, includes an "E"-shaped core member 23 having a center leg member 25 and first and second outer leg members, 27 and 29 respectively. The primary winding 21 is wrapped about the center leg member 25 while a first secondary winding 31 is wrapped about the first outer leg member 27 and a second secondary winding 33 is wrapped about the second outer leg member 29. Also, a plurality of secondary windings, illustrated as third, fourth, and fifth secondary windings 35, 37 and 39, are wrapped about the center leg member 25.

As can more readily be seen in FIG. 1, the first and second secondary windings 31 and 33 are coupled to each other and to the pair of gaseous discharge lamps 11. Also, the third secondary winding 35 is coupled to the filament of one and the fourth secondary winding 37 is coupled to the filament of the other one of the gaseous discharge lamps 11. Moreover, the fifth secondary winding 39 is coupled to the parallel-connected filaments of both of the gaseous discharge lamps 11.

As an illustration of a preferred, but not limiting, embodiment of the transformer 13, the following specific details have been found to be appropriate for use with a pair of 40-watt fluorescent lamps:

"E"-shaped core (23)—2"×1.7"×0.6"

Primary winding (21)—20 turns, 50 strand #36 wire
1st and 2nd secondary windings (31-33)—130 turns, #25 wire 3rd, 4th, and 5th secondary windings (35,37,39)—3 turns #26 wire.

Figure 3:
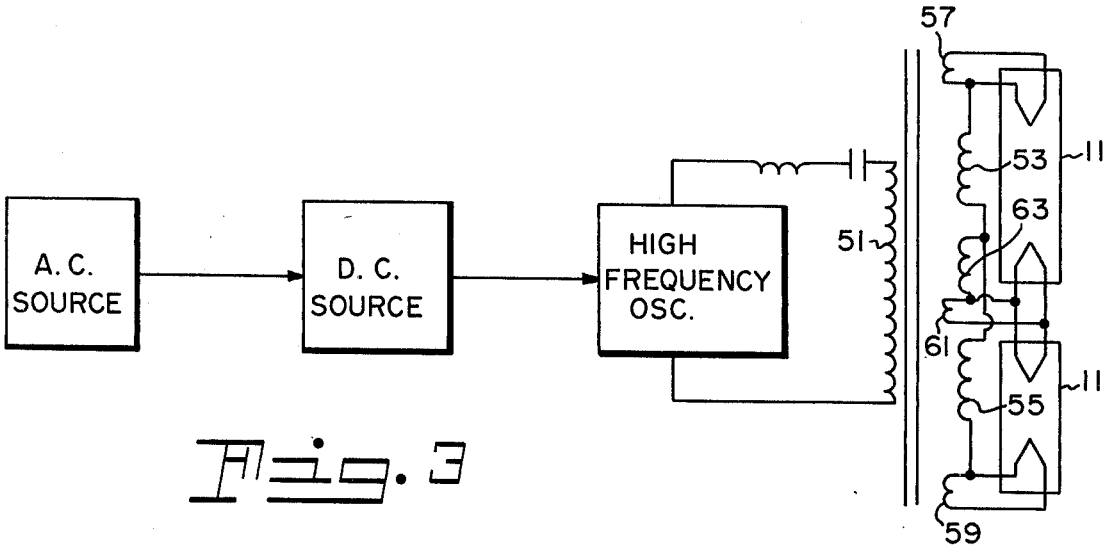
FIG. 3 is an alternate embodiment of electronic ballast for gaseous discharge devices.
Figure 4:
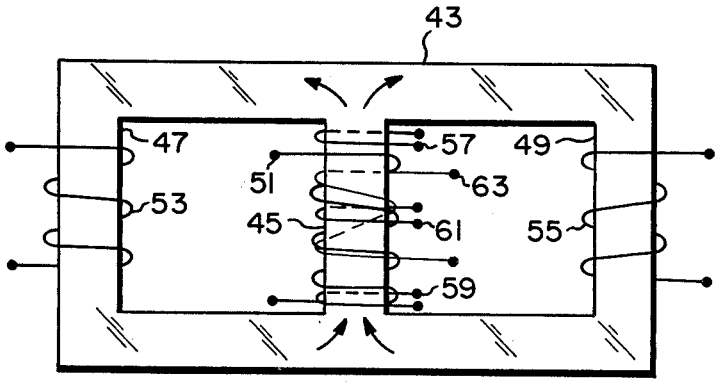
FIG. 4 is an illustration of a transformer fabricated in accordance with the alternate embodiment of FIG. 3.

FIGS. 3 and 4 illustrate an alternate embodiment of the electronic ballast apparatus. Herein, the high frequency inverter means 5 is coupled by the DC rectifier means 7 to an AC potential source 9. However, a transformer 41 couples the high frequency inverter means 5 to the gaseous discharge lamps 11.

In this instance, the transformer 41 includes an "E"-shaped core member 43 having a center leg member 45 and first and second outer leg members 47 and 49. As set forth in the embodiment of FIGS. 1 and 2, a primary winding 51 is wrapped about the center leg member 45 and coupled to the potential source or high frequency inverter means 5. The first and second secondary winding 53 and 55 are wrapped about the first and second outer leg members, 47 and 49 respectively, and coupled to the gaseous discharge lamps 11.

Also, third, fourth, and fifth secondary windings, 57, 59 and 61 are wrapped about the center leg member 45 and connected to the filaments of the pair of gaseous discharge lamps 11. Moreover, a sixth secondary winding 63 is wrapped about the center leg member 45 and coupled to the first and second secondary windings 53 and 55 and to the gaseous discharge lamps 11.

As to fabrication of the apparatus, a high frequency inverter is coupled by a DC rectifier to an AC potential source. The high frequency inverter is also coupled to a pair of gaseous discharge lamps by a transformer. More specifically, an "E"-shaped core member is selected having a center leg member and a pair of outer leg members. A primary winding is wrapped about the center leg member and coupled to the high frequency inverter. First and second secondary windings are wrapped about each one of the outer leg members and coupled to each other and to the pair of gaseous discharge lamps. Also, third, fourth, and fifth secondary windings are wrapped about the center leg member of the transformer and coupled to the filaments of the gaseous discharge lamps.

In operation, the rectifier means 7 receives a potential from the AC potential source 9 and provides a DC potential for energizing the high frequency inverter 5. The high frequency inverter 5 includes an oscillator which responds to the input from the rectifier means 7 and provides a 20 Kc output to the primary winding 21 of the transformer 13.

Also, the energized primary winding 21 develops a flux which is utilized to activate the third, fourth, and fifth windings 35, 37, and 39 and provide energization to the filaments of the pair of gaseous discharge lamps 11. Moreover, the flux developed by the primary winding 21 is substantially equally divided between the first and second secondary windings 31 and 33 disposed on the first and second outer leg members 27 and 29 and connected to the gaseous discharge lamps 11.

When the flux field at one of the first and second secondary windings 31 and 33 is of a magnitude such that the gaseous discharge lamp 11 coupled thereto is ignited, the resistance of the associated secondary winding is increased. Thereupon, the flux appearing at the opposite one of the first and second secondary windings 31 and 33 increases in an amount sufficient to provide an increased potential and cause ignition of the other one of the gaseous discharge lamps 11. Thus, the first and second secondary windings 31 and 33 act differentially to enhance ignition of the gaseous discharge lamps 11 coupled thereto.

Further, the added sixth secondary winding 63 of the alternate embodiments of FIGS. 3 and 4 is coupled to the primary winding 51 such that the flux developed at the center leg member 45 is intensified. In turn the intensified flux is applied to the differentially coupled first and second secondary windings 53 and 55 to the gaseous discharge lamps 11. Thus, ignition of the gaseous discharge lamps 11 is effected in the manner previously described with respect to FIGS. 1 and 2.

Thus, there has been provided unique electronic ballast apparatus previously unavailable in so far as is known. The apparatus provides enhanced electronic ballast operation due to the flux differentiation effects of the secondary windings. Also, the apparatus is inexpensive of both components and labor. Moreover, the electronic ballast apparatus is relatively free from heavy and cumbersome components which is of significance in installation of lighting apparatus.

While there has been shown and described what is at present considered the preferred embodiments of the invention, it will be obvious to those skilled in the art that various changes and modifications may be made therein without departing from the invention as defined by the appended claims.

What is claimed is:

1. Electronic ballast apparatus for operating a pair of gaseous discharge lamps comprising:
   - a high frequency inverter means coupled by a rectifier means to an AC potential source; and
   - transformer means coupling said high frequency inverter means to said pair of gaseous discharge lamps, said transformer means including:
   - an "E"-shaped core member having center and first and second outside leg members;
   - a primary winding wrapped about said center leg member and coupled to said high frequency inverter means;
   - a first secondary winding wrapped about said first outside leg member and coupled to one of said pair of gaseous discharge lamps; and
   - a second secondary winding wrapped about said second outside leg member and coupled to the other one of said gaseous discharge lamps and to said first secondary winding whereby flux is differentially divided between said first and second secondary windings in inverse proportion to the ignition of said first and second gaseous discharge lamps.

2. The electronic ballast apparatus of claim 1 including third, fourth, and fifth secondary windings wrapped about said center leg member and coupled to the filaments of said pair of gaseous discharge lamps.

3. The electronic ballast apparatus of claim 1 wherein said high frequency inverter means includes an inductor and capacitor series connected to said primary winding and coupled to an oscillator means.

4. A process for fabricating electronic ballast apparatus comprising the steps of:
   - coupling a high frequency inverter means to an AC potential source by means of a DC rectifier means; and
   - coupling said high frequency inverter means to a pair of gaseous discharge lamps by means of a transformer means, said coupling of said transformer means including the steps of:

selecting an "E"-shaped core member having a center leg and first and second outer leg members;

wrapping a primary winding on said center leg member and coupling said primary winding to said high frequency inverter means;

wrapping a first secondary winding on one of said first and second outer leg members and coupling said first secondary winding to one of said pair of gaseous discharge lamps; and wrapping a second secondary winding on the other one of said first and second outer leg members and coupling said second secondary winding to the other one of said pair of gaseous discharge lamps and to said first secondary winding whereby flux developed by said primary winding is differentially distributed to said first and second secondary windings in inverse relationship to the ignition of said pair of gaseous discharge lamps.

5. The process of claim 4 including the steps of wrapping a third, fourth, and fifth secondary windings on said center leg member and coupling said windings to the filaments of said pair of gaseous discharge lamps.

6. The process of claim 4 including the step of winding a sixth secondary winding on said center leg member and coupling said sixth secondary winding to said first and second secondary windings.

7. The process of claim 4 wherein said high frequency inverter means includes an oscillator means and an inductor and capacitor coupled to said oscillator means and in series connection with said primary winding.

* * * * *